US010906619B2

(12) United States Patent
Kreijkamp et al.

(10) Patent No.: US 10,906,619 B2
(45) Date of Patent: Feb. 2, 2021

(54) LOAD DISTRIBUTION HARNESS, IN PARTICULAR FOR WATER SPORTS

(71) Applicant: North Actionsports B.V., Katwijk (NL)

(72) Inventors: Guido Kreijkamp, The Hague (NL); Bartholomeus Gerardus Nicolaas Bootsma, The Hague (NL)

(73) Assignee: NORTH ACTIONSPORTS B.V., Katwijk (NL)

( * ) Notice: Subject to any disclaimer, the term of this patent is extended or adjusted under 35 U.S.C. 154(b) by 0 days.

(21) Appl. No.: 16/330,316

(22) PCT Filed: Sep. 6, 2017

(86) PCT No.: PCT/NL2017/050583
§ 371 (c)(1),
(2) Date: Mar. 4, 2019

(87) PCT Pub. No.: WO2018/048301
PCT Pub. Date: Mar. 15, 2018

(65) Prior Publication Data

US 2019/0225309 A1 Jul. 25, 2019

(30) Foreign Application Priority Data

Sep. 6, 2016 (NL) ..... 2017427

(51) Int. Cl.
*B63H 8/54* (2020.01)

(52) U.S. Cl.
CPC ..... *B63H 8/54* (2020.02)

(58) Field of Classification Search
CPC ..... B63B 35/79; B63B 35/7993; B63B 35/00; B63H 8/54; B63H 8/56; B63H 8/58
See application file for complete search history.

(56) References Cited

U.S. PATENT DOCUMENTS 4,026,547 A 5/1977 Silverstolpe
4,315,798 A * 2/1982 Bodendorf ..... E21H 17/07 162/161

(Continued)

FOREIGN PATENT DOCUMENTS

DE 19755111 A1 12/1997
DE 102007028373 A1 6/2007

(Continued)

OTHER PUBLICATIONS

International Search Report from PCT/NL2017/050583 dated Oct. 6, 2017.

(Continued)

*Primary Examiner* — Stephen P Avila
(74) *Attorney, Agent, or Firm* — Adsero IP

(57) ABSTRACT

A load distribution harness for water based sports includes a stiffening shell provided with composite material. The stiffening shell has a support plate from fibre reinforced sheet material having thermoplastic matrix material with fibres embedded therein. The support plate is substantially C-shaped. The support plate extends continuously from a first end region that in use extends to a first end of the spreader bar, via a midsection that in use extends along the body of the user, preferably along the lumbar region of the user, to a second end region that in use extends to a second end of the spreader bar.

23 Claims, 7 Drawing Sheets

(56) References Cited

U.S. PATENT DOCUMENTS

| | | | | |
|---|---|---|---|---|
| 4,452,161 | A | 6/1984 | McCoy | |
| 5,328,398 | A | 7/1994 | Aubrey | |
| 6,293,215 | B1 * | 9/2001 | Moorrees | A62B 35/0031 114/39.18 |
| 7,267,064 | B2 | 9/2007 | Perale | |
| 9,758,221 | B2 | 9/2017 | Harrington | |
| 2004/0224590 | A1 * | 11/2004 | Rawa | B29C 70/088 442/176 |
| 2006/0005754 | A1 | 1/2006 | Perale | |
| 2009/0311927 | A1 | 12/2009 | Goode | |
| 2013/0008742 | A1 | 1/2013 | Schurian | |
| 2015/0004859 | A1 | 1/2015 | Tascheri D'Ausilio | |
| 2015/0165246 | A1 | 6/2015 | Betcher | |
| 2018/0029676 | A1 | 2/2018 | Buckley | |

FOREIGN PATENT DOCUMENTS

| | | | |
|---|---|---|---|
| DE | 102010040301 | A1 | 6/2010 |
| EP | 0043107 | | 1/1982 |
| EP | 0284454 | | 9/1988 |
| EP | 1923420 | A1 | 11/2006 |
| EP | 2439068 | A1 | 10/2010 |
| EP | 2426047 | A2 | 9/2011 |
| GB | 696143 | | 11/1950 |
| GB | 2443284 | A | 8/2007 |
| JP | 07009632 | | 1/1995 |
| NL | 1035657 | | 1/2010 |
| WO | WO 2000/053416 | | 9/2000 |

OTHER PUBLICATIONS

Texon_87_Series_2007_Counter_Stiffener_Product_Info Texon 87 Series (2007) Counter Stiffener Product Information; Website [Online] Available Website: http://www.usm-americas.com/assets/pdfs/Texon%2087%20Series.pdf; Last Update: unknown; Accessed on: Feb. 9, 2017.

TKB_The_KiteBoarder_2016 Buyer's_Guide_Ride_Engine TKB The KiteBoarder (2016) 2016 Buyer's Guide: Ride Engine; Website [Online] Available Website: https://www.thekiteboarder.com/2015/12/2016-buyers-guide-ride-engine/; Last Update: Jun. 29, 2017; Accessed on: Feb. 9, 2017.

YouTube_2015_2016_Dakine_C1_Hard_Back_Waist_Harness YouTube (2015) 2016 Dakine C1 Hard Back Waist Harness; Website [Online] Available Website: https://youtube.com/watch?v=ipnRNPhmlFo; Last Update: unknown; Accessed on: Feb. 10, 2017.

Facebook_2012_08_15_Ride_Engine_Photos Facebook (Aug. 15, 2012) Ride Engine Photos, "Ian and his mustache checking out his new ride"; Website [Online] Available Website: https://www.facebook.com/ride.engine/photos/a.422730161107104.93643.316840578362730/422730164404 37/?type=3&theater; Last Update: unknown; Accessed on: Aug. 15, 2012.

Facebook_2012_10_13_Ride_Engine_Photos Facebook (Oct. 13, 2012) Ride Engine Photos, "My neighbor Jeff is sure to get radical on his shiny new engine. Handmade with care and stoke."; Website [Online] Available Website: https://www.facebook.com/ride.engine/photos/a.422730161107104.93643.316840578362730/444603942253059/?type=3&theater; Last Update: unknown; Accessed on: Oct. 13, 2012.

Facebook_2013_01_25_Ride_Engine_Photos Facebook (Jan. 25, 2013) Ride Engine Photos, "New invention! The is a prototype for an upcoming product, The Plastech . . . "; Website [Online] Available Website: https://www.facebook.com/ride.engine/photos/a.422730161107104.93643.316840578362730/487357027977750/?type=3&theater; Last Update: unknown; Accessed on: Jan. 25, 2013.

Facebook_2013_12_20_Ride_Engine_Photos Facebook (Dec. 20, 2013) Ride Engine Photos, "Looks like F-One decided to steal my idea. Prepare for war, imitators will be crushed."; Website [Online] Available Website: https://www.facebook.com/ride.engine/photos/a.422730161107104.93643.316840578362730/633620680018050/?type=3&theater; Last Update: unknown; Accessed on: Dec. 20, 2013.

Facebook_2014_08_15_Ride_Engine_Photos Facebook (Aug. 15, 2014) Ride Engine Photos, "Molds of people's backs. #SoMany"; Website [Online] Available Website: https://www.facebook.com/ride.engine/photos/a.422730161107104.93643.316840578362730/753440011369449/?type=3&theater; Last Update: unknown; Accessed on: Aug. 15, 2014.

Facebook_2015_04_15_Ride_Engine_Photos Facebook (Apr. 15, 2015) Ride Engine Photos, "Detail of the stealth elite shell"; Website [Online] Available Website: https://www.facebook.com/ride.engine/photos/a.422730161107104.93643.316840578362730/888429554537160/?type=3&theater; Last Update: unknown; Accessed on: Apr. 15, 2015.

Facebook_2015_04_22_Ride_Engine_Photos Facebook (Apr. 22, 2015) Ride Engine Photos, "Sneak peak at the soon to be released . . . #stoked #SpaceAmorForNinjas"; Website [Online] Available Website: https://www.facebook.com/ride.engine/photos/a.422730161107104.93643.316840578362730/891973330849449/?type=3&theater; Last Update: unknown; Accessed on: Apr. 22, 2015.

Facebook_2015_05_15_Ride_Engine_Photos Facebook (May 15, 2015) Ride Engine Photos, "Sebastien Mailloux: Great Job Coleman! Can't wait to try one"; Website [Online] Available Website: https://www.facebook.com/ride.engine/photos/a.422730161107104.93643.316840578362730/887988824581 23/?type=3&theater; Last Update: unknown; Accessed on: May 15, 2015.

Facebook_2015_06_11_Ride_Engine_Photos Facebook (Jun. 11, 2015) Ride Engine Photos, "The future is almost here . . . "; Website [Online] Available Website: https://www.facebook.com/ride.engine/photos/a.422730161107104.93643.316840578362730/915742188472563/?type=3&theater; Last Update: unknown; Accessed on: Jun. 11, 2015.

Facebook_2015_07_09_Ride_Engine_Photos Facebook (Jul. 9, 2015) Ride Engine Photos, "Pre-Production samples of the highly anticipated . . . fundraiser in Hood River, OR."; Website [Online] Available Website: https://www.facebook.com/ride.engine/photos/a.422730161107104.93643.316840578362730/931228310257284/?type=3&theater; Last Update: unknown; Accessed on: Jul. 9, 2015.

Facebook_2015_07_13_Photo_php Facebook (Jul. 13, 2015) Photo_php, "Engine Harnesses Everywhere!—BIJ Hood River Event Site."; Website [Online] Available Website: https://www.facebook.com/photo.php?fbid=10153070680999352&set=a.10153070673339352.1073741905.626289351&type=3&theater; Last Update: unknown; Accessed on: Jul. 13, 2015.

Facebook_2015_07_14_Ride_Engine_Kiteboard_for_Cancer Facebook (Jul. 14, 2015) Ride Engine Photos, "Ride Engine attends Kiteboard for Cancer this past weekend in Hood River, OR."; Website [Online] Available Website: https://www.facebook.com/ride.engine/photos/pcb.9335074446696037/933505340029581/?type=3&theater; Last Update: unknown; Accessed on: Jul. 14, 2015.

Facebook_2015_07_14_Ride_Engine_Photos Facebook (Jul. 14, 2015) Ride Engine Photos, "Met Mike Haase."; Website [Online] Available Website: https://www.facebook.com/ride.engine/photos/a.422730161107104.93643.316840578362730/933505480029567/?type=3&theater; Last Update: unknown; Accessed on: Jul. 14, 2015.

Facebook_2015_07_15_Photo Facebook (Jul. 15, 2015) Photo, "I took #43 for a spin."; Website [Online] Available Website: https://https://www.facebook.com/photo.php?fbid=10206295007247865&set=p.10206295007247865&type=3&theater; Last Update: unknown; Accessed on: Jul. 15, 2015.

Facebook_2015_10_09_Ride_Engine_Photos Facebook (Oct. 9, 2015) Ride Engine Photos, "Oct. 2013 on the left. Oct. 2015 on the right. Proof . . . something."; Website [Online] Available Website: https://www.facebook.com/ride.engine/photos/a.422730161107104.93643.316840578362730/100564276657020/?type=3&theater; Last Update: unknown; Accessed on: Oct. 9, 2015.

Facebook_2015_10_14_Ride_Engine_Photos Facebook (Oct. 14, 2015) Ride Engine Photos, "Team Elite."; Website [Online] Available Website: https://www.facebook.com/ride.engine/photos/a.

(56) References Cited

OTHER PUBLICATIONS 422730161107104.93643.316840578362730/1002909306422517/?type=3&theater; Last Update: unknown; Accessed on: Oct. 14, 2015.

Facebook_2015_11_24_Ride_Engine_Photos Facebook (Nov. 24, 2015) Ride Engine Photos, "What makes our harness different than the rest? . . . #harnessreinvented"; Website [Online] Available Website: https://www.facebook.com/ride.engine/photos/a.422730161107104.93643.316840578362730/1020945637952217/?type=3&theater; Last Update: unknown; Accessed on: Nov. 24, 2015.

Goon_Bunny_2013_07_25_Foto_Phone_image Goon.bunny (Jul. 25, 2013) Foto of phone image "samlight1, oronkessel en 44 anderen vinden dit leuk goon.bunny Space armor for ninjas".

Goon_Bunny_2015_06_04_Foto_Phone_image Goon.bunny (Jun. 4, 2015) Foto of phone image "colleenjcarroll, jesserichman en 127 anderen vinden dit leuk goon.bunny #new #bamboo #prototype".

Goon_Bunny_2015_06_25_Foto_Phone_image Goon.bunny (Jun. 25, 2015) Foto of phone image "goon.bunny #tbt to 3 years ago riding the first piece . . . Pretty amazed how this has all come together. @zorro_del_mar".

Hanglos_NL_2013_11_11_News_311154_pp._1-3 Hanglos.NL (Nov. 11, 2013) News 311154, pp. 1-3, "Review: Engine Armor Custom Harness"; Website [Online] Available Website: https://hanglos.nl/news/311154/review-engine-armor-custom-harness.html; Last Update: unknown; Accessed on: Nov. 11, 2013.

Houston_Kiteboarding_2015-09-20_Ride_Engine_Harnesses HoustonKiteboarding.com (Sep. 20, 2015) "Ride Engine Harnesses Are In!"; Website [Online] Available Website: https://houstonkiteboarding.com/ride-engine-harnesses-in/; Last Update: unknown; Accessed on: Sep. 20, 2015.

Issuu_com_2015-09_Kiteworld_Magazine Issuu.com (Sep. 2015) "Ride Engine Launches First Full Product Lineup at Surf Expo 2016)"; Website [Online] Available Website:https://issuu.com/rideengine/docs/2016_re_catalog_issuu_fnl; Last Update: unknown; Accessed on: Sep. 2015.

Kite_sista_zone_March_2013_Maui_Movement Kite.sista.zone (Mar. 2013) "James Boulding and Sam Medysky kiteboarding in Maui"; Website [Online] Available Website: https://kitesista.com/maui-movement; Last Update: unknown; Accessed on: Mar. 2013.

KiteBoarder_com_2015_07_11_Kiteboarding_4_Cancer KiteBoarder.com (Jul. 11, 2015) Kiteboarding-4-Cancer Photos; Website [Online] Available Website: https://www.thekiteboarder.com/2015/07/2015-kiteboarding-4-cancer/; Last Update: unknown; Accessed on: Jul. 11, 2015.

KiteBoarder_Magazine_2015_05_06_Ride_Engine_Joins_Forces_with_7_Nation KiteBoarder Magazine (May 6, 2015) "Ride Engine Joins Forces with 7 Nation", pp. 1-4; Website [Online] Available Website: https://www.thekiteboarder.com/2015/05/ride-engine-joins-forces-with-7-nation; Last Update: unknown; Accessed on: Mar. 16, 2018.

Ride_Engine_2015_05_06_Story_Evolution_of_Armor_pp._1-2 Facebook (May 6, 2015) Story "Evolution of Armor", pp. 1-2; Website [Online] Available Website: http://www.rideengine.com/STORY/About-Us.html; Last Update: unknown; Accessed on: Apr. 5, 2018.

SeaBreeze_com_2013_02_20_Forums_Kitesurfing_Gear_Reviews SeaBreeze.com (Feb. 20, 2013) "Forums>Kitesurfing>Gear Reviews"; Website [Online] Available Website: https://www.seabreeze.com.au/forums/Kitesurfing/Review/Engine-Handmade-Custom-Harness?page=1; Last Update: Feb. 20, 2013; Accessed on: Feb. 20, 2013.

SeaBreeze_com_2018_03_23_Engine_Handmade_Custom_Harness SeaBreeze.com (Mar. 23, 2018) "Engine Handmade Custom Harness"; Website [Online] Available Website:https://www.seabreeze.com.au/forums/Kitesurfing/Review/Engine-Handmade-Custom-Harness?page=-2; Last Update: Feb. 20, 2013; Accessed on: Mar. 23, 2018.

Snowkiting_2015_09_12_Ride_Engine_Trapeze Snowkiting.at (Sep. 12, 2015) "Ride Engine Trapeze"; Website [Online] Available Website: https://www.snowkiting.at/phpBB3/viewtopic.php?f=2&t=2443; Last Update: unknown; Accessed on: Sep. 12, 2015.

Surfforum_2012_Comment_from_ripper_tom Surfforum (2012) Comment from ripper tom Salzburg; Website [Online] Available Website: http://surfforum.oase.com/showthread.php?t=158748; Last Update: unknown; Accessed on: Sep. 10, 2015.

TKB_The_Kiteboarder_com_2015_May_Ride_Engine_Joins_forces_with_7_Nation TKB The Kiteboarder.com (May 12, 2015) "Ride Engine Joins forces with 7 Nation"; Website [Online] Available Website: https://www.thekiteboarder.com/2015/05/ride-engine-joins-forces-with-7-nation/; Last Update: unknown; Accessed on: May 2015.

Vimeo_2015_04_30_Prologue_126538440_pp._1-2 Vimeo.com (Apr. 30, 2015) "Prologue.", pp. 1-2; Website [Online] Available Website: https://vimeo.com/126538440; Last Update: unknown; Accessed on: Apr. 30, 2015.

Vimeo_2015_06_11_Why_Ride_Engine_130448555_pp._1-2 Vimeo.com (Jun. 11, 2015) "Why Ride Engine?", pp. 1-2; Website [Online] Available Website: https://vimeo.com/130448555; Last Update: unknown; Accessed on: Jun. 11, 2015.

Vimeo_2015_09_TheKiteMag_Surf_Expo Vimeo.com (Sep. 2015) "TheKiteMag & Surf Expo—Ride Engine Harness"; Website [Online] Available Website: https://vimeo.com/139549256; Last Update: unknown; Accessed on: Sep. 2015.

YouTube_2015_10_13_2016_Ride_Engine_Harness_Overview_wAlex_Fox YouTube (2015) "2016 Ride Engine Harness Overview w/ Alex Fox"; Website [Online] Available Website: https://youtube.com/watch?v=ej3G7zXKv-0; Last Update: unknown; Accessed on: Oct. 13, 2015.

* cited by examiner

TOP VIEW

BACK VIEW

SIDE VIEW3

SECTION VIEW A-A

FRONT VIEW

TOP VIEW

FRONT VIEW

FRONT VIEW

FRONT VIEW

FRONT VIEW

FRONT VIEW

FRONT VIEW

FRONT VIEW

FRONT VIEW

SECTION VIEW B-B

PERSPECTIVE VIEW

BACK VIEW

TOP VIEW

BACK VIEW

LOAD DISTRIBUTION HARNESS, IN PARTICULAR FOR WATER SPORTS

RELATED APPLICATIONS

This application is a 35 U.S.C. § 371 national phase application of PCT/NL2017/050583 (WO 2018/048301), filed on Sep. 6, 2017, entitled "Load Distribution Harness, in Particular for Water Sports", which application claims priority to Netherlands Application No. 2017427, filed Sep. 6, 2016, which is incorporated herein by reference in its entirety.

The invention generally relates to a load distribution harness, in particular for water based sports. Load distribution harnesses are well known, and are often for water based sports such as kite surfing, windsurfing, sailing, SUP, wakeboarding, or waterskiing. Load distribution typically harnesses comprise a body support that in use is connected to a spreader bar for connection to a pulling element, such as a kite, sail or tug rope. The body support and the spreader bar are connectable to each other so that the harness in use encircles the lower part of the torso of a user and distributes a pulling load exerted on the spreader bar by the pulling element over the body of the user, preferably over the lumbar region of the user. The load distribution harness may e.g. be embodied as a waist, hip or vest type harness. The harness may also be embodied as a seat harness, i.e. type of harness with loops that extend around the legs of the user.

For example, a kiteboarder captures the power of the wind with a large controllable power kite to be propelled across the water on a kiteboard. A kite harness connects the kiteboarder with the kite. The harness together with the spreader bar attaches the rider to the control bar of the kite. By hooking in, the harness takes most of the strain of the kite's pull off of the rider's arms, and spreads it across a portion of his body, mainly the torso, and preferably the lumbar region. This allows the rider to do jumps and other tricks while remaining attached to the kite via the control bar.

A disadvantage of current harnesses is the lack of support. Traditionally, the harnesses are made of fabric and/or of non-woven materials that mainly secure the connection with the pulling element. Most harnesses found on the market do not offer any back support by spreading the (pull) forces well over the torso. On those that claim to give support, the support systems are often not sufficient as they have more an aesthetical function. Under higher pulling forces, these harnesses may pinch the torso significantly.

Some harnesses are provided with stiffening shells, e.g. rigid plates made of fiber reinforced material of thermosetting matrix material and continuous fibres, e.g. carbon fibres. Due to the use of epoxy the part is relatively thick and heavy and rigid, and results in an in-tolerant fitting shape. Due to the rigidness (non-flexibility) the harness cannot be adjusted very well in circumference. This typically causes the harness to move upwards during use. This problem is e.g. common in kitesurfing: when the kite occupies a position in the sky with an angle over 45 degrees relative to the sea or the rider's back, the vertical component of the pull force pushes the harness up towards the chest.

The invention aims to provide a load distribution harness that alleviates one or more of the above disadvantages. In particular, the invention aims to provide a load distribution harness that fits ergonomically, that absorbs impact, that is durable yet thin and light weight.

Thereto the invention provides for a load distribution harness, in particular for water based ports, comprising a body support that in use is connected to a spreader bar for connection to a pulling element, the body support and the spreader bar being connectable to each other so that the harness in use encircles the lower part of the torso of a user and distributes a pulling load exerted on the spreader bar over the body of the user, preferably over the lumbar region of the user, the body support including a stiffening shell provided with composite material, characterized in that the stiffening shell comprises a support plate from fibre reinforced sheet material having thermoplastic matrix material with fibres embedded therein, which support plate is substantially C-shaped and extends continuously from a first end region that in use extends to a first end of the spreader bar, via a midsection that in use extends along the body of the user, preferably along the lumbar region of the user, to a second end region that in use extends to a second end of the spreader bar.

The combination of thermoplastic polymer material and the continuous C-shape allows the shell to be stiff at the midsection with relatively flexible end regions, and to generally be formed more ergonomically. It also allows the shell to flex in case of an impact or an overload so that it stays comfortable, and does not break easily. The continuous extension of the thermoplastic composite support plate also allows the tensile load to be coupled directly into the support plate via the end regions. The shape and material further allow absorption of impact, which is e.g. useful when a user lands hard after a jump with the kite. In addition, the material allows the shell to be thin and lightweight, yet durable under watersports conditions.

When the support plate includes a main sheet of the thermoplastic matrix material with continuous fibres embedded therein that extends continuously from the first end region via the midsection to the second end region, a very strong yet lightweight and thin construction may be achieved.

When the support plate comprises a further sheet of the thermoplastic matrix material with the continuous fibres embedded therein that is thermally bonded to the main sheet, the strength of the support plate may be increased.

When the further sheet is superimposed on the main sheet as a local reinforcement, and leaves peripheral areas of the main sheet free, weight may be saved, and flexibility may be retained where desired.

When the resistance against bending of the support plate in an opening or closing direction of the C-shape is lower at the end regions than at the midsection, the harness may adapt to the shape of the body of the user very well, and very good semi-flexibility may be achieved.

When the support plate is at the midsection the support plate is provided with a stiffening profile, in particular a rib profile, a mid-section may be created that is stiffer than the first and second end regions very efficiently.

Typically, the first and second end regions may be provided with webbing that in use connects the first and second ends of the support plate to the respective first and second ends of the spreader bar. When the webbing is anchored directly to the first and second end regions of the support plate, in use the load from the spreader bar may be transferred directly to the support plate. Advantageously, the webbing may be anchored to the support plate by bonding, stitching and/or passing through the support plate at the respective first and second end region.

When the support plate includes a padding material that is anchored to the support plate, in particular to a side of the support plate that in use faces the body of the user, preferably the lumbar region of the user, a very ergonomical and sturdy construction is achieved. Advantageously, the padding material may be anchored to the support plate by bonding, stitching and/or passing through the support plate at the respective first and second end region.

When the harness includes a cladding material that is anchored to the support plate, in particular by bonding or stitching, the compactness and sturdiness may be increased even further.

Typically, the load distribution harness may include a spreader bar for connection to a pulling element, comprising a first end that is connected to the first end region of the support plate and a second end that in use is connected to the second end region of the support plate. The spreader bar may typically include a hook for hooking up to the pulling element.

When the support plate is formed from one or more prefabricated, flat sheets, in particular thermoplastic composite material, sheets may be used that are pre-produced, and that are readily commercially available. Advantageously, the support plate may be pre-molded into shape.

The invention also relates to a stiffening shell for a harness, comprising a support plate from fibre reinforced sheet material having thermoplastic matrix material with fibres embedded therein, which support plate is substantially C-shaped and extends continuously from a first end region that in use extends to a first end of the spreader bar, via a midsection that in use extends along the body of the user, preferably the lumbar region of the user, to a second end region that in use extends to a second end of the spreader bar.

The invention further relates to the use of a sheet of thermoplastic matrix material with fibres embedded therein for a support plate of a stiffening shell of a load distribution harness, in particular for waters based sports.

It should be noted that the technical features described above may each on its own be embodied in a load distribution harness of stiffening shell isolated from the context in which it is described here, separate from other features or in combination with only a number of features described in the context in which it is disclosed herein. Each of these features may further be combined with any other feature disclosed, in any combination.

The invention will be further elucidated on the basis of non imitative exemplary embodiments represented in the drawings. In the drawings.

Figure 9:
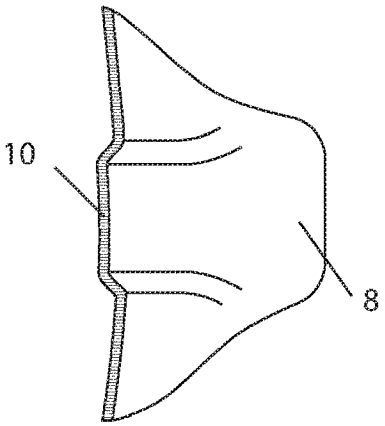
Figure 8:
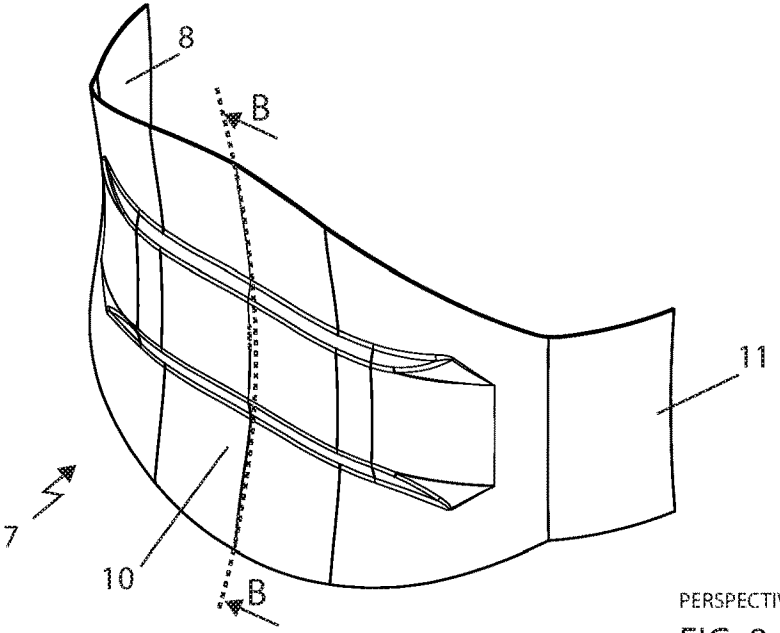
Figure 10:
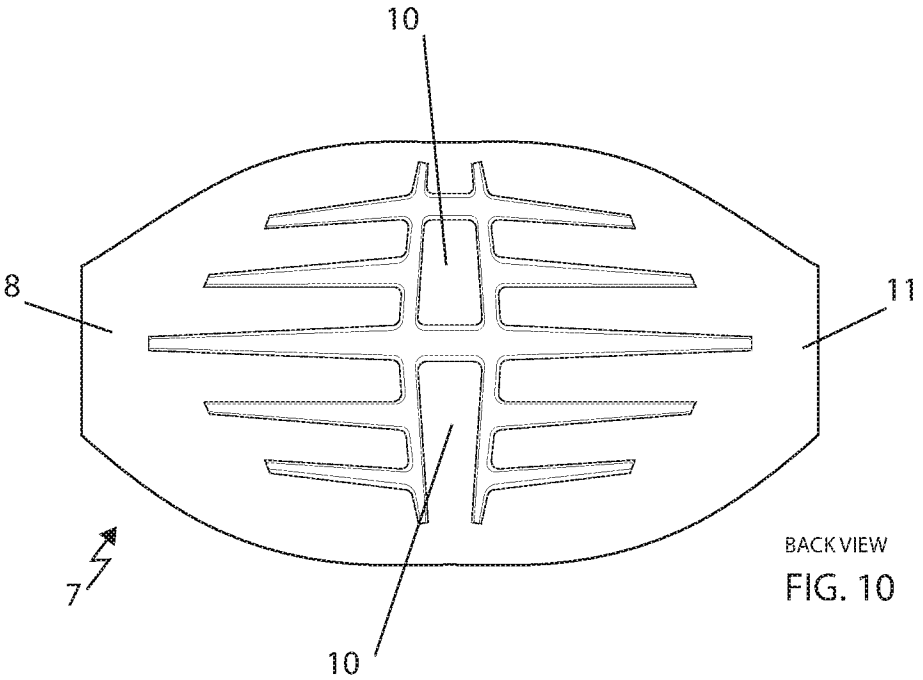
Figure 11:
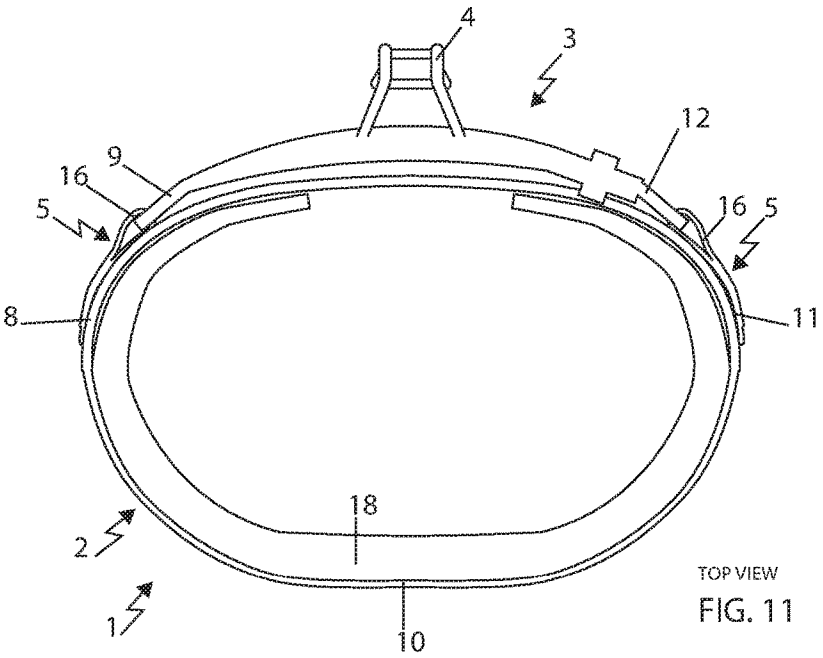
Figure 12:
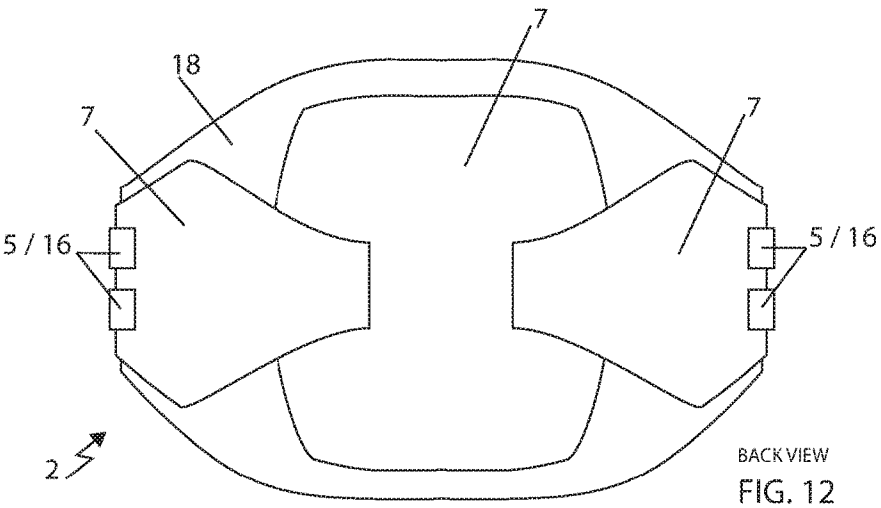

FIGS. 7A-H show schematic rear views of alternative stiffening shells;

FIG. 8 shows a schematic perspective top view of a further alternative stiffening shell;

FIG. 9 shows a schematic cross sectional view of the stiffening of FIG. 8 shell along the line B-B in FIG. 8;

FIG. 10 shows a schematic rear view of an alternative stiffening shell including intersecting upward and transverse ribs in the support plate;

FIG. 11 shows a schematic top view of a further embodiment of the load distribution harness in which the end regions of the substantially C-shaped support plate are interconnected, and FIG. 12 shows a schematic rear view of embodiment of the harness of the invention in which the midsection and the end regions of the support plate are composed of bonded sheets of thermoplastic composite material.

It should be noted that the figures are merely schematic representations of preferred embodiments of invention. In the figures, identical or corresponding parts are represented with the same reference numerals.

Figure 1:
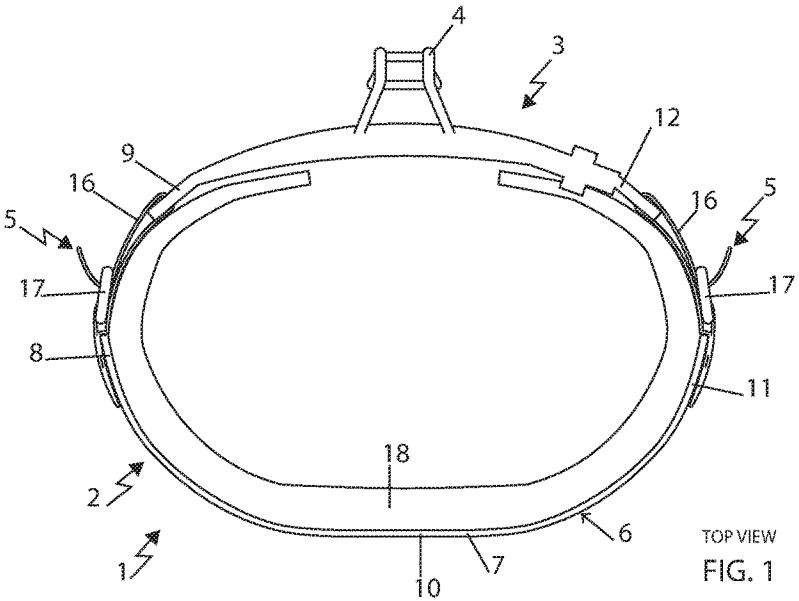
FIG. 1 shows a schematic top view of a first embodiment of a load distribution harness.
Figure 2:
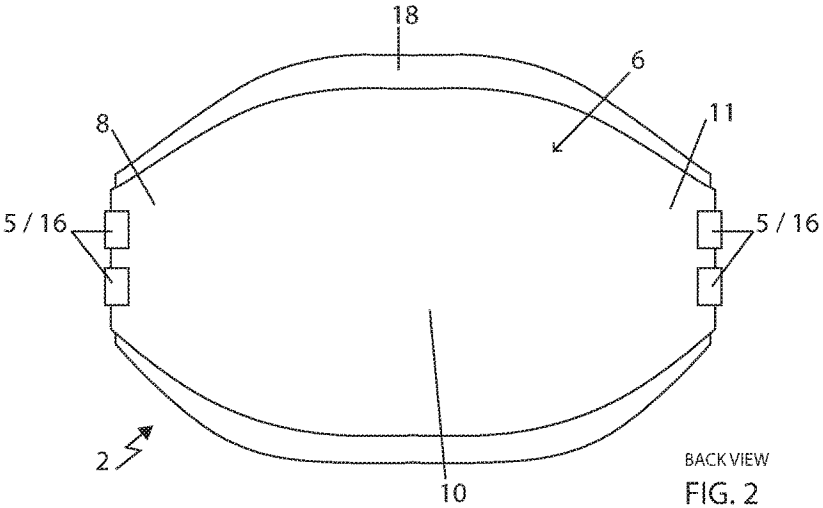
FIG. 2 shows a schematic rear view of the load distribution harness of FIG. 1.
Figure 3:
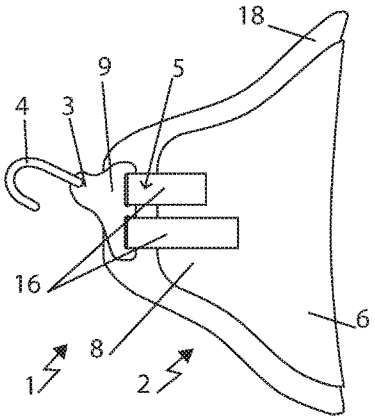
FIG. 3 shows a schematic side view of the load distribution harness of FIG. 1.

Referring to FIGS. 1-3, a first exemplary embodiment of a load distribution harness 10 is shown. In this embodiment, the load distribution is configured as a kite-surfing harness, to be worn by a kite surfer around the waist. The load bearing harness 10 comprises a body support 2, in particular a lumbar support. The support 2 is in use is connected to a spreader bar 3. The spreader bar 3 comprises a hook 4 that in use is connected to the harness loop of the control bar of a kite that forms a pulling element for the user. As shown in FIG. 1 the body support 2 and the spreader bar 3 are connectable to each other via webbing 5 so that the harness 1 in use encircles the lower part of the torso of a user. The harness 1 distributes the pulling load exerted on the spreader bar 3 by the kite over the body of the user, in particular over the lumbar region of the body.

The first and second end regions 8, 11 are provided with webbing 5 that in use connects the first and second end regions 8, 11 of the support plate to the respective first and second ends 9, 12 of the spreader bar 3. The webbing 5 is in this example embodied as two straps 16, e.g. made out of nylon, that each loop through the an end 9,10 of the spreader bar 3 and through an end region 8, 11 of the support plate 7. The straps 16 each include a buckle 17, with which the connection may be tightened and released. As an alternative, the webbing may e.g. include wires, cables, ropes, belts, chains or tie-wraps or any other type of connecting element.

The body support 2 includes a stiffening shell 6 that is provided with thermoplastic composite material. In particular, the stiffening shell 6 comprises a support plate 7 that is made from fibre reinforced sheet material having thermoplastic polymer matrix material with continuous fibres embedded therein.

Thermoplastic composite is made out of a combination of fibres and thermoplastic plastic. The material has a very high stiffness, is light weight and has a very high impact resistance. As the fibres are reinforced with a thermoplastic it is possible to change the shape of the material by heat. It is also possible to melt multiple layers of thermoplastic composite together so that certain areas can be thicker—and thus stronger and/or more rigid than others.

In particular, the fibres form strands that extend through the matrix material. The fibres may advantageously be oriented in the matrix at least substantially longitudinally. This way, the fibres may e.g. be orientated to best absorb the pulling load on the support plate load. Also, using longitudinal orientation of the fibres they may be oriented to provide stiffness to the support plate 7 to resist closing of the C-shape, yet maintain flexibility in other bending directions. Advantageously, the strands are woven into a mat, that is embedded in the thermoplastic matrix material. The fibres may be woven in a conventional plane weave, but may also be woven in a customized pattern, e.g. a jacquard weave to provide a tailored degree of local reinforcement. There may be several plies of fiber mats in the sheet. As an alternative, the fibres may also be braided into a mat, or may extend unidirectionally, e.g. in superimposed layers. Also, the sheet may include one or more continuous fibers that are laid to extend in the sheet ill a custom pattern, e.g. a meandering pattern or parallel individual fiber strands. Such meandering pattern may include a fibre strand that has been laid in a loop that has parallel legs that are interspaced with varying distance. Such custom pattern may include superimposed fibre stands, e.g. a one ore more fibre strands that cross meandering fibre(s). The custom pattern may include several interspaced parallel legs of a single meandering fibre or several parallel fibre stands that extend from top to bottom along the support plate. One or more fibres may be laid to follow the contour of peripheral edge of the support plate at a distance, e.g. several interspaced parallel legs of a single meandering fibre or several parallel fibre stands that extend from side to side transversely along the support plate, and that follow the contour of the top- and bottom edges. This way, the support may be provided with a varying resistance to bending along both its transverse and longitudinal axis. Various fibre types can be used, e.g. carbon, glass, aramid, plastics (PE, PA, PP, etc.), hemp, etc. Also a variety of thermoplastic matrix materials can be used, amongst others TPU, PA6, PA66, PA12, PP, PE, PEEK, PC, etc.

Suppliers of suitable thermoplastic composite materials are e.g. Ten Cate, which offers under the brand name 'CETEX', Lankhorst, which offers under the brand name 'PURE', Lanxess, offers under the brand name 'TEPEX' and Propex, offers under the brand name 'CURV'.

Figure 6:
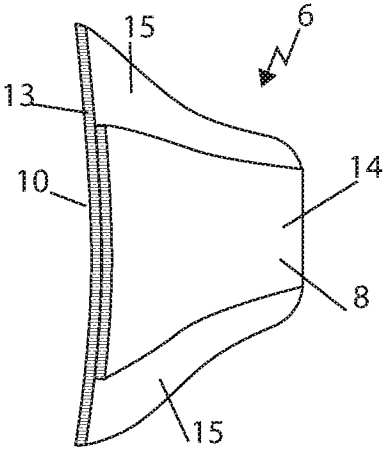
FIG. 6 shows a schematic cross sectional view of the stiffening shell of FIG. 4 along the line A-A in FIG. 5.
Figure 5:
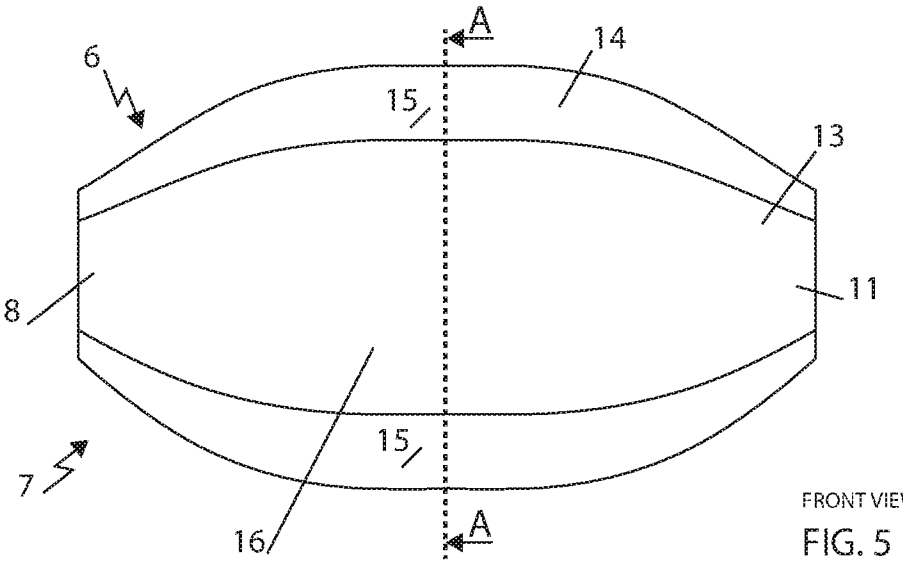
FIG. 5 shows a schematic front view of the stiffening shell of FIG. 4.
Figure 4:
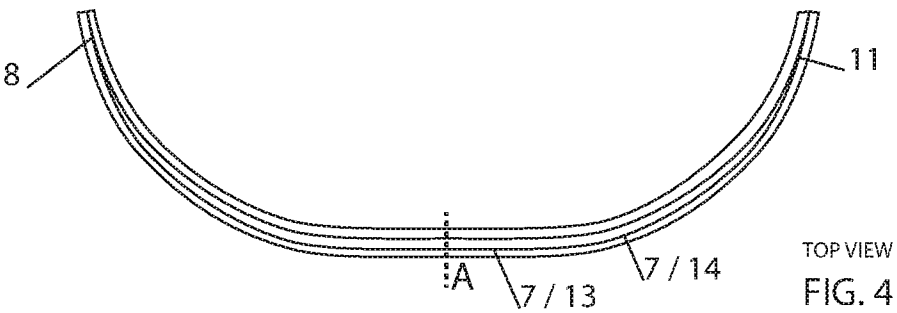
FIG. 4 shows a schematic top view of a stiffening shell for the load distribution harness of FIG. 1.

The support plate is shown in FIGS. 4-6 and is substantially C-shaped. It extends continuously from a first end region 8 that in use extends to a first end 9 of the spreader bar 3, via a midsection 10 that in case of this example extends along the lumbar region of the user, to a second end region 11 that in use extends to a second end 12 of the spreader bar 3.

The combination of thermoplastic polymer material and the continuous C-shape shown allows the shell to be stiff at the midsection with relatively flexible end regions, and to generally be formed more ergonomically. It also allows the shell to flex in case of an impact or an overload so that it stays comfortable, and does not break easily. The continuous extension of the thermoplastic composite support plate also allows the tensile load to be coupled directly into the support plate via the end regions. The shape and material further allow absorption of impact, which is e.g. useful when a kite rider lands hard after a jump with the kite. In addition, the material allows the shell to be thin and lightweight, yet durable under watersports conditions.

The support plate 7 is formed from one or more prefabricated, flat sheets. Typically, the support plate 7 may be cut from flat plates of the thermoplastic fibre reinforced matrix material. During this cutting process, apertures may be cut through which other components, e.g. webbing straps or lettering, may later be anchored directly through the support plate. In this embodiment, the support plate is at its end regions 8,11 provided with slits through which the straps 16 of the webbing 5 are looped. This way, the pulling load of the kite may be coupled directly into the support plate 7.

The flat sheets can be pre-molded into shape in a heated press mold that has a mold cavity of the desired 3 dimensional shape for the support plate. During the molding process, several sheets may be thermally bonded together. After molding into shape, the support plate 7 may be overmolded to allow anchoring of other components of the stiffening shell 6 or thermal bonding of e.g. padding material, lettering or even cladding material to the support plate. Overmolding may take place in a separate mold, or in the same mold e.g. via a subsequent injection step of material, preferably thermoplastic material.

The support plate includes a main sheet 13 of the thermoplastic matrix material with the continuous fibres embedded therein. The main sheet 13 extends continuously from the first end region 8 via the midsection 10 to the second end region 11. The main sheet 13 is in this embodiment a single piece, and is preferably formed as one piece from a prefabricated sheet of thermoplastic fiber reinforced material. However, the main sheet alternatively may be composed of several parts that are bonded together, e.g. by thermal bonding or gluing, to form an integral sheet.

The support plate 7 comprises in this embodiment a further sheet 14 of the thermoplastic material. Preferably, this is also embodied as a thermoplastic matrix material with the continuous fibres embedded therein that is thermally bonded to the main sheet. Alternatively or in addition, such further sheets 14 may include a non-composite (thermoplastic) sheet. The further sheet 14 is in this embodiment superimposed on the main sheet 13 as a local reinforcement, and leaves peripheral areas 15 of the main sheet 13 free.

This way, the resistance against bending of the support plate in an opening or closing direction of the C-shape is lower at the end regions 8, 13 than at the midsection 10. This effect is also provided by making the height of the end sections smaller than the height of the midsection.

As can be taken from FIG. 6, the support plate 7 is in this example at the midsection provided with a stiffening profile, formed by a curvature in the sheet. As shown, the slightly hollow form at the side facing away from the first and second end regions 8,11 also allows the support to follow the anatomy of the small of the lower back at the lumbar region.

Figure 7B:
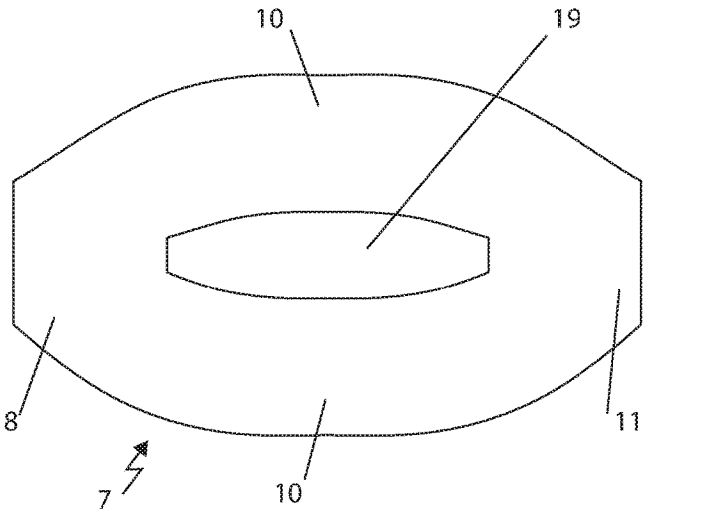
Figure 7D:
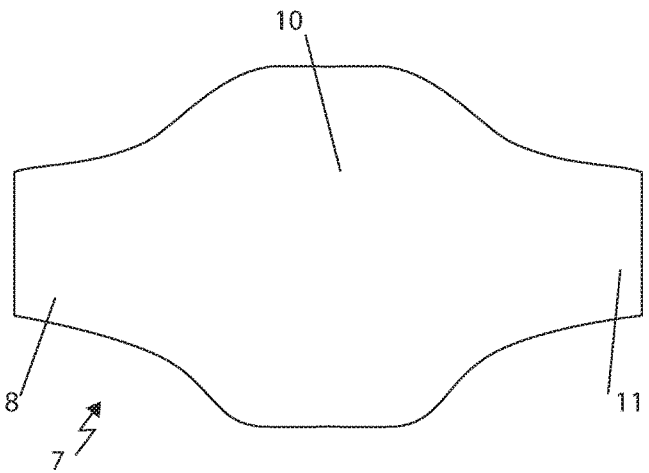
Figure 7A:
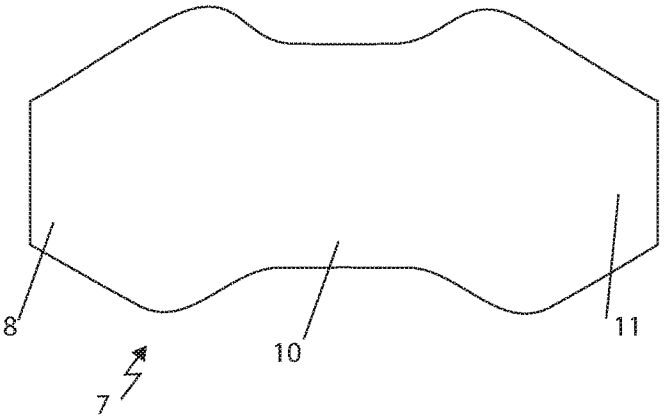
Figure 7C:
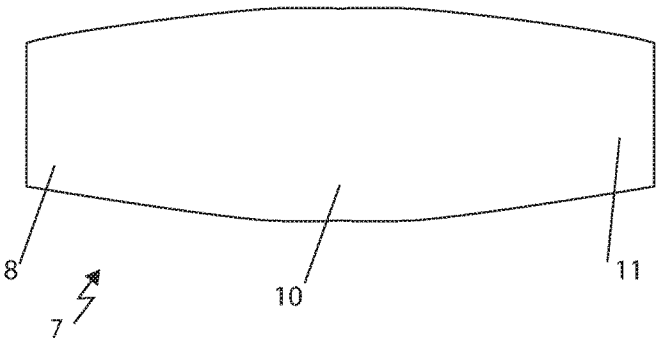
Figure 7F:
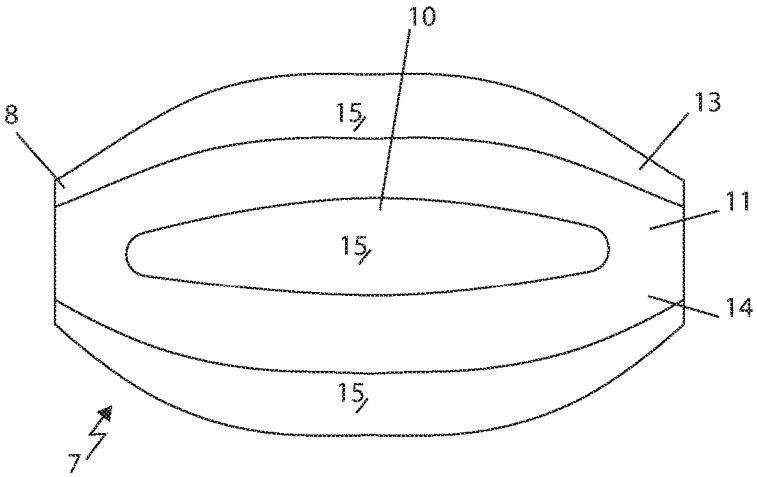
Figure 7E:
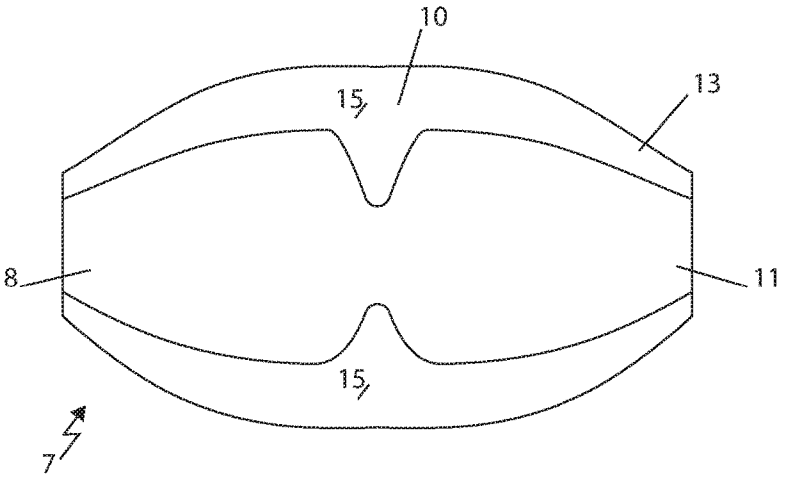
Figure 7H:
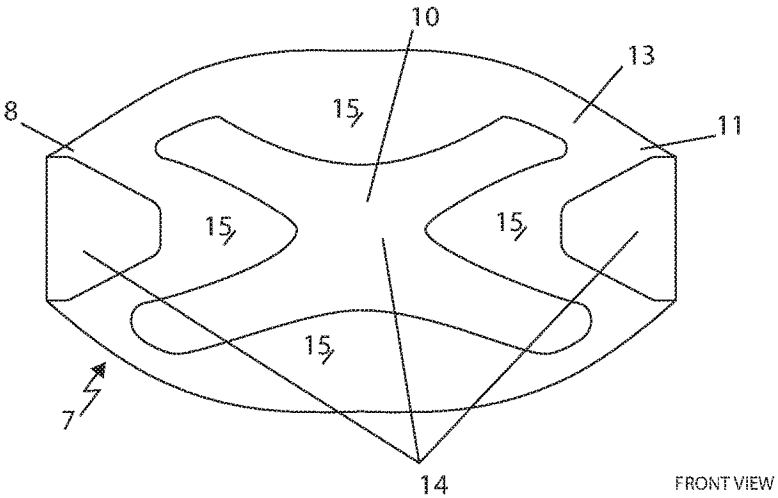
Figure 7G:
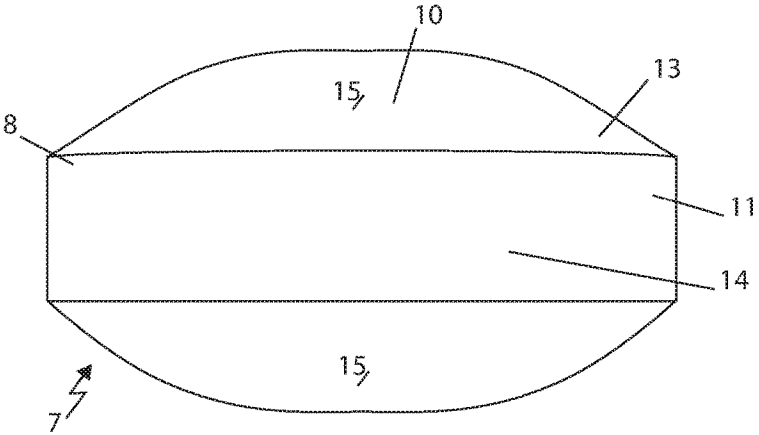

A selection of alternative embodiments of the support plate are shown in FIGS. 7A-G. FIGS. 7A-D show embodiments without local reinforcement, built op of a single or multiple main sheet. In 7A, the zones 16 between the midsection 10 and the end regions 8, 13 are made of increased height to provide localized resistance to bending. This way, especially the bent zones of the support plate 7 may be stiffened. In FIG. 7B, a cutout 17 is provided in the center of the midsection 10. This way, e.g. torsional flexibility may be enhanced. FIGS. 7E-H show embodiments with further sheets 14 as local reinforcement, in which flexibility and stiffness are modified locally to provide for the need of different styles of kiteboarding. In FIG. 7E the center of the midsection is relatively less stiffened. In FIG. 7F an opening 19 is provided in the further sheet to provide relative torsional flexibility. In FIG. 7H an embodiment is shown with multiple further sheets 14. This way, the local reinforcements may act more independently.

In FIGS. 8 and 9 it is shown that the support plate 7 may be provided with a pronounced stiffing profile, here embodied as a rib profile. Such profiles may advantageously formed during molding of the thermoplastic material, as is set out more in detail further below. An alternative stiffening profile with a plurality of ribs, in particular both upward and transverse ribs, and intersecting ribs in the support plate is shown in FIG. 10. This increases overall impact resistance of the support plate, and has esthetic appeal.

In this example, the webbing 5 is anchored directly to the first and second end regions 8,11 of the support plate 7 by passing through the support plate 7 to in use transfer the load from the spreader bar 3 directly to the support plate 7. As an alternative or in addition, the webbing 5 may be anchored to the support plate 7 by bonding and/or stitching. Preferably, the webbing 5 may be anchored to the support plate 7 by thermal bonding, for example by heat pressing the thermoplastic material of the straps 16 onto the thermoplastic matrix material of the support plate 7. This way, the webbing and the support plate 7 may become integrally formed. As an alternative, the webbing may be bonded by gluing. The load distribution harness 1 in this example includes a padding material. 18 that is anchored to the support plate 7, in particular to a side of the support plate that in use faces the lumbar region of the user. The padding material 18 in this example is thermoplastic material that is thermally bonded to the support plate 7 in an over-molding process. As an alternative or in addition, the padding material may be anchored by gluing, and/or stitching. Advantageously, stitching may a pass through the thermoplastic fiber reinforced material in a regular sewing process. The stitching may the pass in between the fibres to transfer the load. Preferably, the stitching passes through areas of the support plate that comprise only a single or double sheet of the fibre reinforced thermoplastic material, i.e. a single or double ply. The support plate may at its peripheral area and/or anchoring locations of webbing be provided with only a single or double ply of the fibre reinforces thermoplastic material, and with more plies at areas. Advantageously, a conventional industrial sewing process may then be used to apply the stitching.

The load distribution harness 1 may further include a cladding material (not shown), e.g. a nylon woven fabric and/or a neoprene material that is anchored to the support plate, in particular by bonding or stitching. This allows for a very sturdy harness of which the cladding does not shift, and which can take the extreme wear and tear of watersports use.

Essentially, the load bearing harness 1 as set out in the embodiments above is a semi-stiff shell, which may be designed not to twist or distort. The body support plate 7 spreads the load on the body, for most water based sports the back, evenly and allows you to enjoy the ultimate in comfort whilst also maintaining in profile. The supporting plate on the outside is made of a thermoplastic composite material that allowed it to be shaped in the desired form whilst still being thin, and thus light weight. The thermoplastic composite material is superior in strength, yet in combination with the shape, the support plate remains flexible as well. This gives the harness a unique flexibility that makes it very tolerant for all types of users as well as very comfortable in use. This plate gives the harness unique characteristics and superior performances in regards to shock absorption, body support and strain-relief, convenient usability, safety, comfort and superior anatomic fit to both male and female body-shapes. The support plate of the harness is moulded and padded to sit and in the lumbar of the user's back, so that it locks in place and stays comfortable.

The load distribution harness of the invention harness may e.g. be embodied as a waist, hip, seat harness (with loops that extend around the legs of the user), or vest type harness. The harness be in other embodiments be shaped and configured for other types of water based sports than kite-surfing, e.g. windsurfing, sailing, SUP, wakeboarding, or waterskiing. In some embodiments, e.g. SUP, the support plate of the body support may be configured to support the front of the torso. In yet other embodiments, the end regions 8, 11 of the support plate 7 may interconnect opposite the midsection 10 to form an O, such as shown in FIG. 11. In such embodiments the substantial C-shape of the support plate is comprised in O-shape of the load distribution harness.

FIG. 12 shows a schematic rear view of an embodiment of the harness of the invention in which the midsection 10 and the end regions 8, 11 of the support plate 7 are composed of thermally bonded sheets of thermoplastic composite material. The harness 1 may in further embodiments be shaped and configured for non-water based sports, e.g. rock climbing or paragliding.

The invention is not limited to the exemplary embodiments represented here, but include variations. For example, the manufacturing process may be different than described in this example. The support plate may be thermoformed or vacuum formed, and may also be cold pressed. The sheets of the may alternatively be glued or sewn together. Also the harness may be of different type than in the example. The load distribution harness or stiffening shell may include more than one support plate, e.g. two or three, and such additional support plates may be releasably attached so that the stiffness of the support plate may be easily configured or adapted to meet the needs of the user.

Such variations shall be clear to the skilled person and are considered to fall within the scope of the invention as defined in the appended claims.

LIST OF REFERENCE SIGNS

1. Load distribution harness
2. Lumbar support
3. Spreader bar
4. Hook
5. Webbing
6. Stiffening shell
7. Support plate
8. First end region support plate
9. First end spreader bar
10. Midsection support plate
11. Second end region support plate
12. Second end spreader bar
13. Main sheet
14. Further sheet
15. Peripheral area
16. Strap
17. Buckle
18. Padding material
19. Opening

The invention claimed is:

1. A load distribution harness for water based sports, comprising: a body support that in use is connected to a spreader bar for connection to a pulling element, the body support and the spreader bar being connectable to each other so that the harness in use encircles the lower part of a torso of a user and distributes a pulling load exerted on the spreader bar over a lumbar region of the user, the body support including a stiffening shell provided with composite material, wherein the stiffening shell comprises a support plate from fibre reinforced sheet material having thermoplastic matrix material with fibres embedded therein, which support plate is substantially C-shaped and extends continuously from a first end region that in use extends to a first end of the spreader bar, via a midsection that in use extends along the lumbar region of the user, to a second end region that in use extends to a second end of the spreader bar, wherein the support plate includes a main sheet of the thermoplastic matrix material with continuous fibres embedded therein that extend continuously from the first end region via the midsection to the second end region, wherein the support plate comprises a further sheet of the thermoplastic matrix material with the continuous fibres embedded therein that is thermally bonded to the main sheet, and wherein the further sheet is superimposed on the main sheet as a local reinforcement, and leaves peripheral areas of the main sheet free.

2. A load distribution harness for water based sports, comprising: a body support that in use is connected to a spreader bar for connection to a pulling element, the body support and the spreader bar being connectable to each other so that the harness in use encircles the lower part of a torso of a user and distributes a pulling load exerted on the spreader bar over a lumbar region of the user, the body support including a stiffening shell provided with composite material, wherein the stiffening shell comprises a support plate from fibre reinforced sheet material having thermoplastic matrix material with fibres embedded therein, which support plate is substantially C-shaped and extends continuously from a first end region that in use extends to a first end of the spreader bar, via a midsection that in use extends along the lumbar region of the user, to a second end region that in use extends to a second end of the spreader bar, and in which a resistance against bending of the support plate in an opening or closing direction of the C-shape is lower at the end regions than at the midsection.

3. The load distribution harness of claim 2, in which the support plate includes a main sheet of the thermoplastic matrix material with continuous fibres embedded therein that extend continuously from the first end region via the midsection to the second end region.

4. The load distribution harness of claim 2, in which the support plate comprises a further sheet of the thermoplastic matrix material with the continuous fibres embedded therein that is thermally bonded to the main sheet.

5. The load distribution harness of claim 2, in which at the midsection the support plate is provided with a stiffening profile to create a mid-section that is stiffer than the first and second end regions.

6. The load distribution harness of claim 1, in which the first and second end regions are provided with webbing that in use connects the first and second ends of the support plate to the respective first and second ends of the spreader bar.

7. The load distribution harness of claim 6, in which the webbing is anchored directly to the first and second end regions of the support plate to in use transfer the load from the spreader bar directly to the support plate.

8. The load distribution harness of claim 7, in which the webbing is anchored to the support plate by bonding, stitching and/or passing through the support plate at the respective first and second end region.

9. The load distribution harness of claim 1, further including a padding material that is anchored to a side of the support plate that in use faces the lumbar region of the user.

10. The load distribution harness of claim 9, in which the padding material is anchored to the support plate by bonding, stitching and/or passing through the support plate at the respective first and second end region.

11. The load distribution harness of claim 1, further including a cladding material that is anchored to the support plate.

12. The load distribution harness of claim 1, further including the spreader bar for connection to a pulling element comprising a first end that is connected to the first end region of the support plate and a second end that in use is connected to the second end region of the support plate.

13. The load distribution harness of claim 1, in which the support plate is formed from one or more prefabricated, flat sheets.

14. The load distribution harness of claim 1, in which the support plate is pre-molded into shape.

15. The load distribution harness of claim 2, in which the first and second end regions are provided with webbing that in use connects the first and second ends of the support plate to the respective first and second ends of the spreader bar.

16. The load distribution harness of claim 15, in which the webbing is anchored directly to the first and second end regions of the support plate to in use transfer the load from the spreader bar directly to the support plate.

17. The load distribution harness of claim 16, in which the webbing is anchored to the support plate by bonding, stitching and/or passing through the support plate at the respective first and second end region.

18. The load distribution harness of claim 2, further including a padding material that is anchored to a side of the support plate that in use faces the lumbar region of the user.

19. The load distribution harness of claim 18, in which the padding material is anchored to the support plate by bonding, stitching and/or passing through the support plate at the respective first and second end region.

20. The load distribution harness of claim 2, further including a cladding material that is anchored to the support plate.

21. The load distribution harness of claim 2, further including the spreader bar for connection to a pulling element comprising a first end that is connected to the first end region of the support plate and a second end that in use is connected to the second end region of the support plate.

22. The load distribution harness of claim 2, in which the support plate is formed from one or more prefabricated, flat sheets.

23. The load distribution harness of claim 2, in which the support plate is pre-molded into shape.

* * * * *